US007097604B2

(12) United States Patent
Kaluza et al.

(10) Patent No.: US 7,097,604 B2
(45) Date of Patent: Aug. 29, 2006

(54) GUIDE ROLLER FOR A STAMPING MACHINE

(75) Inventors: Georg Kaluza, Lauf (DE); Ralf Friedmann, Heilsbronn (DE)

(73) Assignee: Leonard Kurz GmbH & Co.,KG, Furth (DE)

( * ) Notice: Subject to any disclaimer, the term of this patent is extended or adjusted under 35 U.S.C. 154(b) by 434 days.

(21) Appl. No.: 10/307,890

(22) Filed: Dec. 2, 2002

(65) Prior Publication Data

US 2003/0114283 A1 Jun. 19, 2003

(30) Foreign Application Priority Data

Dec. 5, 2001 (DE) ..... 101 59 662

(51) Int. Cl.
*B25F 5/02* (2006.01)

(52) U.S. Cl. ..... 492/16; 492/47; 492/45

(58) Field of Classification Search ..... 492/16, 492/5, 47, 45; 193/37; 384/601
See application file for complete search history.

(56) References Cited

U.S. PATENT DOCUMENTS 3,349,462 A * 10/1967 Mott ..... 492/16
3,554,420 A * 1/1971 Agius ..... 226/95
3,657,782 A * 4/1972 Mott ..... 29/895.21
3,746,233 A 7/1973 Bauer et al.
4,416,201 A * 11/1983 Kessler ..... 101/348
4,603,458 A * 8/1986 Hirohata ..... 193/37
5,246,155 A 9/1993 Barrois
6,234,078 B1 * 5/2001 Kessler ..... 101/351.6

FOREIGN PATENT DOCUMENTS

DE 44 16 421 A1 11/1995
EP 0 686 781 A2 12/1995

* cited by examiner

*Primary Examiner*—Marc Jimenez
(74) *Attorney, Agent, or Firm*—Hoffmann & Baron, LLP

(57) ABSTRACT

In a guide roller for a stamping machine for deflecting a stamping foil web and/or a substrate web to be stamped upon, so that the guide roller has a negligibly low degree of friction, fixed to a roller spindle that is fixed with respect to the machine is at least one porous air-permeable spindle sleeve at which at least one roller sleeve is rotatably mounted. The roller spindle has a compressed gas passage for acting on the or each spindle sleeve with compressed gas to produce a gas cushion between the or each respective spindle sleeve and the associated roller sleeve.

4 Claims, 4 Drawing Sheets

GUIDE ROLLER FOR A STAMPING MACHINE

This application claims priority based on German Patent Application No. 101 59 662.6, filed on Dec. 5, 2001.

FIELD OF THE INVENTION

The invention relates to a guide roller for a stamping machine, for example for guiding or changing the direction of a web formed by stamping or embossing foil and/or a web of substrate material which is to be stamped or embossed upon.

In the context of the present invention the roller can be used to guide a web of material or to produce a controlled change in the direction of movement thereof. The term guide roller will be used herein to denote such roller functions.

BACKGROUND OF THE INVENTION

Stamping or embossing machines usually have at least one and often a plurality of guide rollers for guiding a web of material as it passes through the machine, the roller or each thereof being supported by means of a ball bearing assembly. Guide rollers of that kind entail such a level of friction that it is only possible to achieve machine speeds of 200 meters per minute. Due to friction, thin narrow foil webs may suffer from unacceptable stretching or in an extreme case may even be damaged to such an extent as to be effectively ruined.

Reference may be made to U.S. Pat. No. 3,349,462 disclosing a guide roller which is intended for use in a textile machine, that is to say for guiding or changing the direction of a textile web as it passes through the machine. The roller has a roller spindle which is fixed with respect to the support structure of the machine, and a porous air-permeable spindle sleeve is fixed to the roller spindle, with the axially remote end portions of the spindle sleeve. A roller sleeve is in turn supported on the spindle sleeve, and the roller spindle has a compressed air passage for supplying the spindle sleeve with compressed air which is operative to form an air cushion between the spindle sleeve and the roller sleeve. It will be noted here that textile webs usually enjoy a relatively high level of mechanical strength so that there is no real fear of friction-induced unacceptable stretching or elongation of the web material, in particular during the phase of starting up the machine. The situation is different when dealing with thin narrow stamping foil webs.

Reference may also be made to DE 44 16 421 A1 disclosing a heatable and coolable roller which is suitable for transporting materials in web form and for providing temperature control in respect thereof. The roller disclosed therein is distinguished by an extremely low level of bearing friction. To support the roller casing which rotates on a fixed cylindrical core, that roller arrangement uses a fluid which flows predominantly in a peripheral direction between the roller casing and the roller core. The fluid can be used at the same time to provide for temperature control of the roller casing. As the fluid used for temperature control flows preferably in the peripheral direction in the region of the usable roller width, that provides for excellent constancy of temperature over the width of the roller.

SUMMARY OF THE INVENTION

An object of the present invention is to provide a guide roller for a stamping machine, which has a comparatively low level of friction so that even thin narrow foil webs are not unacceptably stretched.

Another object of the present invention is to provide a guide roller for guiding a foil web, for use in a stamping machine, which makes it possible to achieve an increase in the machine speed by around the order of magnitude of 50% to increase the machine output.

Still another object of the present invention is to provide a guide roller for a stamping machine, which is of such a structure as to afford a low level of friction while being of structural simplicity such as to enhance the reliability and service life thereof.

In accordance with the present invention the foregoing and other objects are attained in a first aspect of the invention by a guide roller for a stamping machine, for guiding a stamping foil web and/or a substrate web to be stamped upon, comprising a roller spindle adapted to be fixed with respect to the machine and to which a porous air-permeable spindle sleeve is fixed with its axially mutually remote end portions. A roller sleeve is disposed on the spindle sleeve. The roller spindle has a compressed gas or air passage for acting on the spindle sleeve with compressed air for producing an air cushion between the spindle sleeve and the roller sleeve. The roller spindle has at least two mutually axially spaced mounting portions for fixing the end portions of the spindle sleeve while between the two mounting portions is a central portion of reduced diameter. The compressed air passage opens into the central portion. The roller spindle, adjoining the one mounting portion, has a peripherally extending flange against which the air-permeable spindle sleeve bears with its one annular end face. Fixed to the end, that is axially remote from the flange, of the roller spindle is a disk with which the air-permeable spindle sleeve is axially immovably fixed between the disk and the flange.

In accordance with a second aspect of the invention the foregoing and other objects are also attained by a guide roller for a stamping machine, for guiding a stamping foil web and/or a substrate web to be stamped upon, comprising a roller spindle adapted to be fixed with respect to the machine and to which a plurality of porous air-permeable spindle sleeves are fixed with axially mutually remote end portions. A roller sleeve is disposed on each spindle sleeve. The roller spindle has a compressed air passage for acting on the spindle sleeve with compressed air for producing an air cushion between the spindle sleeve and the roller sleeve. The porous air-permeable spindle sleeves are fixed at a spacing from each other by spacer rings to the roller spindle. A roller sleeve is mounted at each spindle sleeve. The compressed air passage of the roller spindle has a number of passage branchings, which corresponds to the number of spindle sleeves, for supplying the spindle sleeves with compressed air. The compressed air is operative to produce an air cushion between each respective spindle sleeve and the associated roller sleeve.

In a third aspect of the invention the foregoing and other objects are attained by a guide roller for a stamping machine, for guiding a stamping foil web and/or a substrate web to be stamped upon, comprising a roller spindle adapted to be fixed with respect to the machine and having two axially spaced end portions. A respective porous air-permeable spindle sleeve has axially remote end portions, by way of one of which each spindle sleeve is fixed to a respective one of the two mutually axially spaced end portions of the roller spindle. Mounted at the spindle sleeves is a roller sleeve. The roller spindle has compressed gas or air passages for acting on the spindle sleeves with compressed gas or air. The compressed gas or air is operative to produce an air cushion between the respective spindle sleeve and the roller sleeve.

It will be noted that in a further preferred feature of each aspect of the invention the or each spindle sleeve may comprise an open-pore sintered metal or an open-pore sintered ceramic.

Further objects, features and advantages of the invention will be apparent from the description hereinafter of preferred embodiments of the invention.

DESCRIPTION OF PREFERRED EMBODIMENTS

Figure 2:
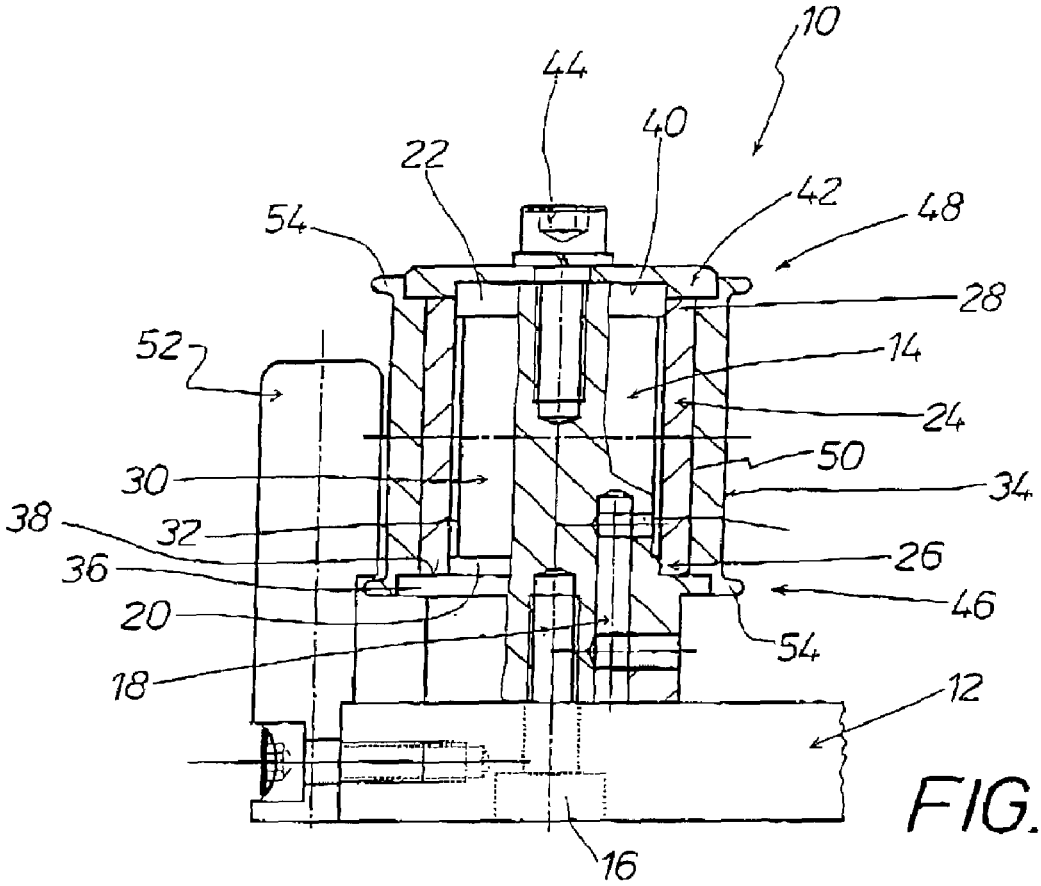
FIG. 2 is a partly sectional side view of the guide roller shown in FIG. 1 viewing in the direction of arrow II in FIG. 1.
Figure 1:
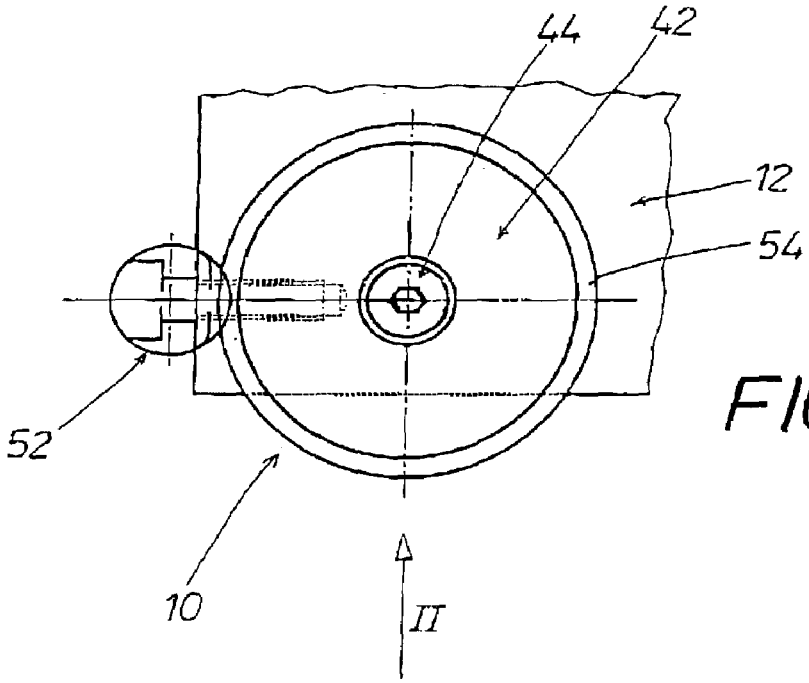
FIG. 1 shows a plan view of a first embodiment of a guide roller according to the invention for a stamping machine.

Referring firstly to FIGS. 1 and 2, shown therein is a first embodiment of a guide roller which is indicated generally by reference numeral 10 and which is intended for use in a foil stamping machine. The guide roller 10 is mounted on a support structure 12 of the stamping machine, of which just a portion is shown here. The guide roller 10 has a roller bar or spindle 14 which is fixed to the machine support structure 12 by means of a suitable fixing screw 16. The roller spindle 14 which is thus fixed with respect to the machine has a compressed air passage 18 extending therein. The roller spindle 14 also has two mounting portions 20 and 22 which are spaced from each other in the axial direction of the elongate roller spindle 14 to which a porous air-permeable spindle sleeve 24 is fixed with the first and second end portions 26 and 28 thereof, which are remote from each other in the axial direction of the roller spindle 14.

Since, as is noted hereinafter, compressed gas can be used in place of compressed air, the spindle sleeve 24 is correspondingly permeable to the gas used.

Between the two mounting portions 20 and 22 the roller spindle 14 has a central portion 30 of reduced diameter, thus resulting in an annular gap or clearance indicated at 32 between the central portion 30 and the porous spindle sleeve 24 surrounding same. The compressed air passage 18 opens out of the roller spindle 14 at the central portion 30 and thus communicates with the annular gap 32. When compressed air is supplied to the compressed air passage 18 the compressed air flows through the compressed air passage 18 and by way of the annular gap 32 to act on the porous spindle sleeve 24.

Reference 34 in FIG. 2 denotes a roller sleeve which is axially immovably but rotatably mounted at the spindle sleeve 24. For that purpose, adjoining the mounting portion 20 the roller spindle 14 which is fixed with respect to the machine support structure 12 has a peripherally extending collar or flange 36 against which the spindle sleeve 24 bears with its one annular end face 38. The roller sleeve 34 is axially immovably held in position by a disk 42 which is fixed by means of a fixing screw 44 at the end 40 of the roller spindle 14, being the end which is axially remote from the peripherally extending flange 36.

The roller sleeve 34 which is mounted rotatably at the porous spindle sleeve 24 projects in a stepped configuration with a first end portion 46 thereof beyond the peripherally extending flange 36 and with a second end portion 48 thereof, which is axially spaced therefrom, beyond the disk 42.

When the compressed air passage 18 is supplied with compressed air, the feed of compressed air into the annular gap 32 results in an air cushion 50 being formed between the porous air-permeable spindle sleeve 24 and the roller sleeve 34, thus affording what is effectively a virtually friction-free support for the roller sleeve 34 in relation to the spindle sleeve 24. The compressed air then escapes between the flange 36 of the roller spindle 14 and the first end portion 46 of the roller sleeve 34 and between the disk 42 and the second end portion 48 of the roller sleeve 34 so that, during operation of the roller in the stamping machine, it is necessary for the compressed air passage 18 to be permanently supplied with compressed air. It will be noted in this respect that instead of compressed air it is also possible to use any other suitable gas under pressure.

Reference numeral 52 in FIG. 2 denotes a contact element in the proximity of the guide roller 10, which is intended to prevent the stamping foil web (not shown) and/or the substrate web (not shown) to be stamped upon, from accidentally jumping off the guide roller 10 as the web or webs are guided therearound.

To provide for precise guidance of the stamping foil web and/or the substrate web, the roller sleeve 34 is provided at each of its two mutually axially remote end portions 46 and 48 with a peripherally extending reel collar 54.

Figure 3:
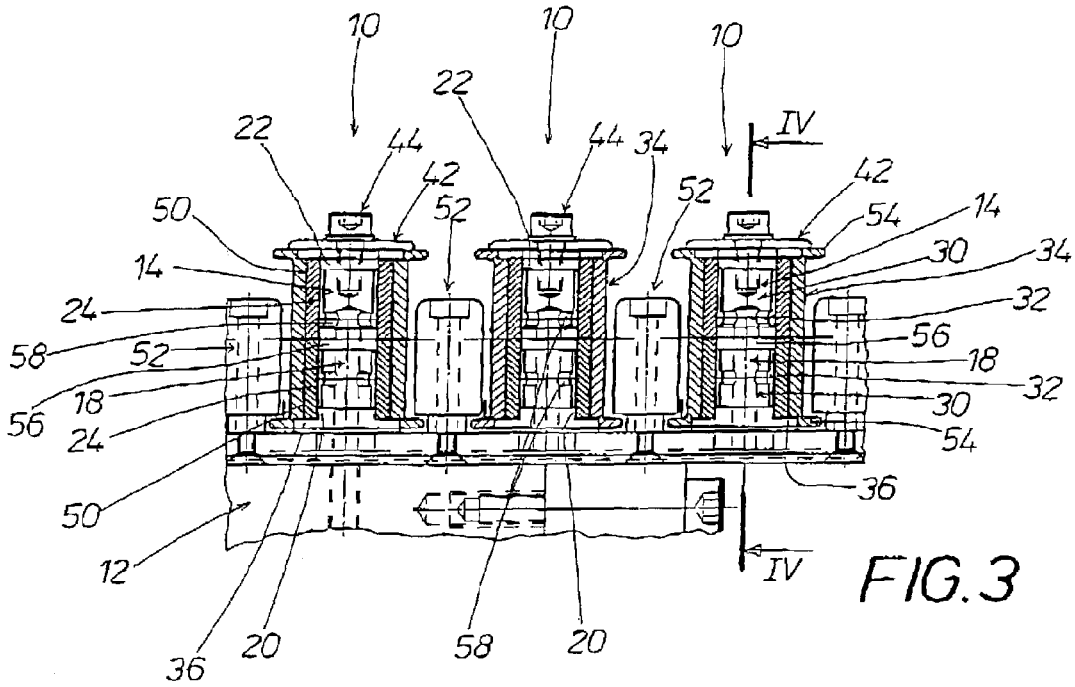
FIG. 3 is a view in section through a second embodiment of guide rollers according to the invention which are arranged in mutually juxtaposed relationship.
Figure 4:
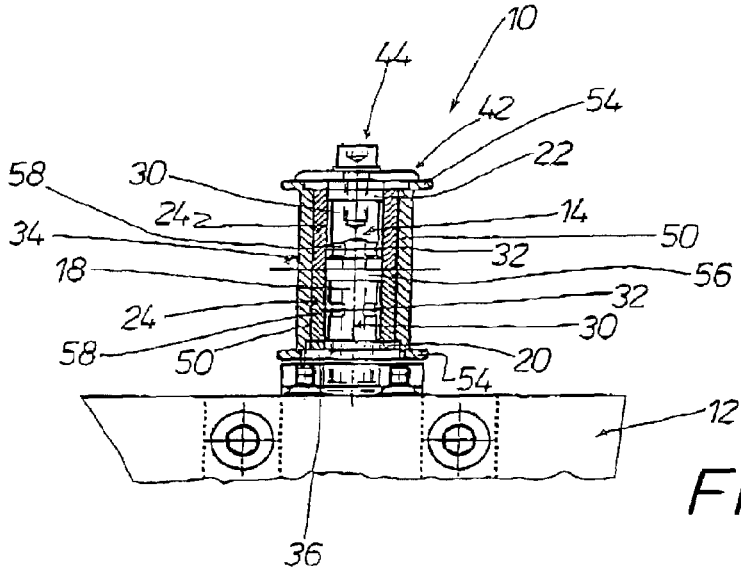
FIG. 4 is a view in section taken along line IV—IV in FIG. 3 through a guide roller.

Reference will now be made to FIGS. 3 and 4 showing a second embodiment of the guide roller 10 according to the invention. Looking at FIG. 3, it will be seen therefrom that a support structure 12 of the stamping machine carries a number of guide rollers 10 which are arranged in mutually spaced juxtaposed relationship. A respective contact element 52 for restraining a web being guided around the guide rollers 10 is provided between each two adjacent guide rollers 10. In this configuration of the guide roller 10 first and second porous air-permeable spindle sleeves 24 are fixed in mutually adjoining relationship on the respective roller spindle 14 which is fixed with respect to the machine support structure. A roller sleeve 34 is axially immovably but rotatably supported on the spindle sleeves 24. To hold the spindle sleeves 24 in the correct positions each respective roller spindle 14 has mounting portions 20 and 22 as described hereinbefore, and also a central mounting portion 56. The mounting portions 20 and 56 define a central portion 30 of reduced diameter, while the mounting portions 22 and 56 in turn define a second central portion 30 of reduced diameter. A compressed air passage 18 provided in the roller spindle 14 has channel branchings indicated at 58, which respectively open into the central portions 30 of reduced diameter in each respective roller assembly. In comparison thereto, the guide roller 10 shown in FIGS. 1 and 2 has the compressed air passage 18 with only one single passage branching where it opens into the central portion 30 therein.

As can further be seen from FIGS. 3 and 4 the roller spindle 14 of each respective guide roller 10, adjoining the mounting portion 20, has a peripherally extending flange 36 against which the associated air-permeable spindle sleeve 24 bears with its annular end face 38. At the end 40 of the roller spindle 14, which is axially remote from the peripherally extending flange 36, a disk 42 is fixed to the roller spindle 14 by means of a fixing screw 44. The disk 42 provides that the associated spindle sleeve 24 is axially immovably fixed in position, jointly with the first spindle sleeve 24, between the disk 42 and the peripherally extending flange 36.

The roller sleeve 34 is axially immovably but rotatably mounted at the two porous spindle sleeves 24. When compressed air is applied through the compressed air passage 18, an air cushion 50 is thus produced between the porous spindle sleeves 24 and the roller sleeve 34, and the roller sleeve 34 is thus rotatably supported virtually in a friction-free condition by means of the air cushion 50.

It will be added here that in FIGS. 3 and 4 the same features and details are denoted by the same references as those used in FIGS. 1 and 2 so that there is no need for the structure of FIGS. 3 and 4 and all the details thereof to be described fully once again at this juncture.

Figure 6:
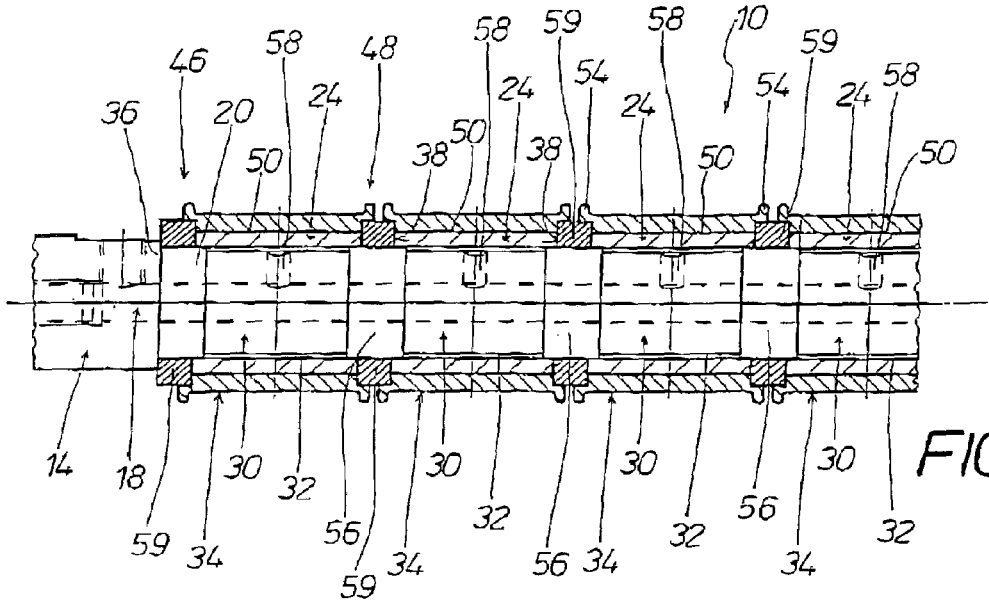
FIG. 6 shows a view in section taken along line VI—VI in FIG. 5.
Figure 5:
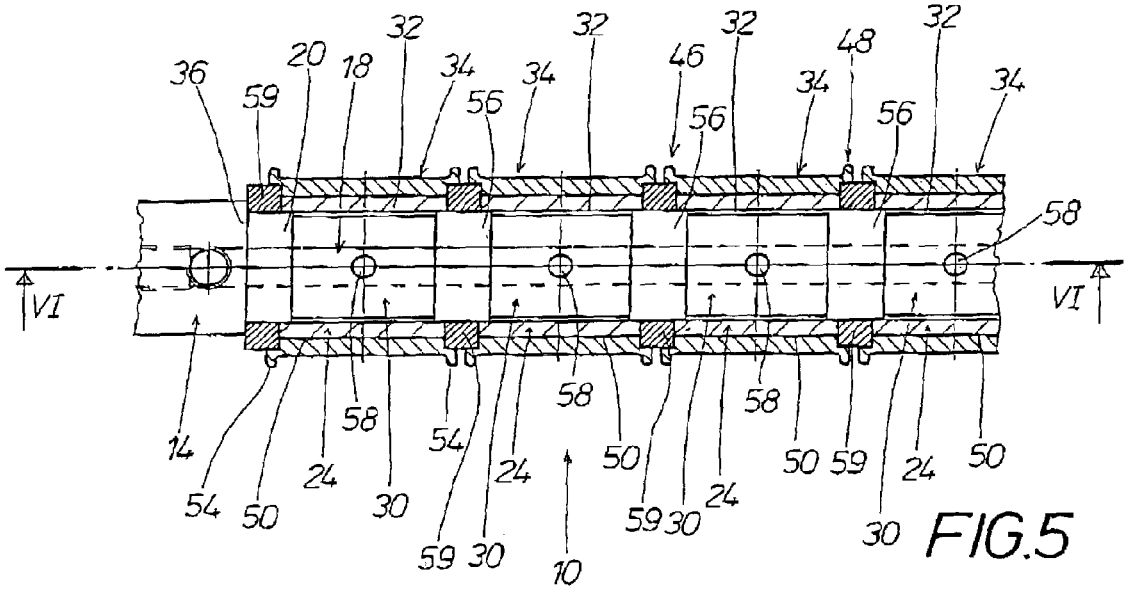
FIG. 5 shows yet another embodiment of a horizontal guide roller with a number of roller sleeves.

Looking now at FIGS. 5 and 6, shown therein is a third embodiment of a guide roller 10 for a stamping machine, in accordance with the invention, for guiding a stamping foil web (not shown) and/or a substrate web (not shown). Once again, in FIGS. 5 and 6 the same features and details are noted by the same references as those used hereinbefore with reference to FIGS. 1 through 4 so that there is no need for all those features and details to be fully described once again, in connection with FIGS. 5 and 6.

It will be seen from FIGS. 5 and 6 however that a number of porous air-permeable spindle sleeves 24 are fixed at a mutual spacing on a long, horizontally arranged roller spindle 14 which is fixed with respect to the support structure of the stamping machine in which the guide roller 10 is used. Spacer rings 59 are arranged on the roller spindle 14 to space the porous spindle sleeves 24 from each other. For the purposes of fixing the porous spindle sleeves 24 on the long roller spindle 14, the latter is, provided with mounting portions 20 and 56. The mounting portion 20 is shown at the end of the roller spindle 14, which is at the left in FIG. 5, and there are a plurality of mounting portions 56 in axially mutually spaced relationship in the longitudinal direction of the roller spindle 14. Provided between the mounting portion 20 and the adjacent mounting portion 56 is a central portion 30 of reduced diameter, and provided between each two adjacent mounting portions 56 is a further respective central portion 30 of reduced diameter. A compressed air passage 18 extending through the roller spindle 14 has passage branchings indicated at 58, each of which opens from the roller spindle 14 at a respective central portion 30.

A roller sleeve 34 is axially immovably but rotatably supported at each porous spindle sleeve 24. When the compressed air passage 18 is supplied with compressed air or another suitable gas under pressure, an air or gas cushion 50 is thus produced between the respective porous spindle sleeve 24 and the associated roller sleeve 34, thereby providing for virtually friction-free support for the respective roller sleeve 34.

Figure 7:
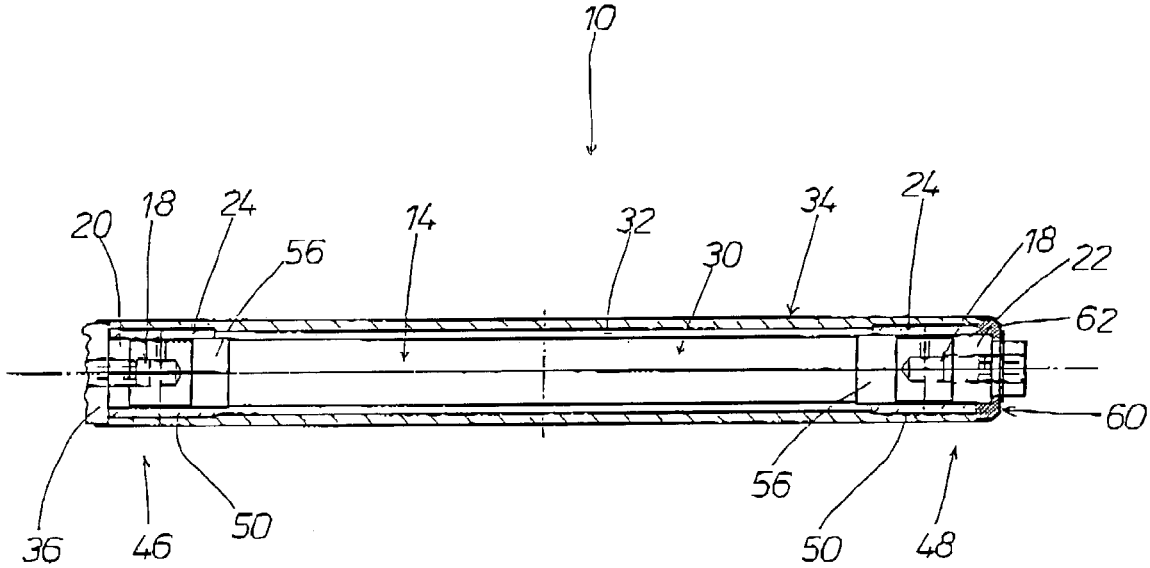
FIG. 7 is a view in longitudinal section of still another embodiment of the guide roller according to the invention.

FIG. 7 shows yet another embodiment of the guide roller 10 comprising a roller spindle 14 which is fixed with respect to a support structure of the stamping machine in which the guide roller 10 is to be used. The roller spindle 14 has a respective porous air-permeable spindle sleeve 24 at each of its two end portions which are relatively widely spaced from each other in the axial direction of the elongate roller spindle 14. Each respective porous spindle sleeve 24 is fixed at associated mounting portions 20, 56 and 22, 56 respectively. A central portion 30 of reduced diameter is defined between the spindle portions 20 and 56 at the left-hand end of the guide roller 10 shown in FIG. 7, and between the mounting portions 22 and 56 at the right-hand end of the roller 10 shown in FIG. 7. Associated with each central portion 30 is a respective compressed air or gas passage 18 which opens into the associated annular gap 33 in order to act on the corresponding spindle sleeve 24 with compressed air or other suitable compressed gas. Adjoining the mounting portion 20 of the roller spindle 14 is a peripherally extending flange 36 against which the associated spindle sleeve 24 and also a roller sleeve 34 axially immovably bear. The roller sleeve 34 is rotatably supported at the two axially mutually remote porous spindle sleeves 24.

Secured to the second end portion of the roller spindle 14, which is axially remote from the flange 36, is a fixing element 60 formed by a disk or a ring as indicated at 62. The roller sleeve 34 is axially immovably but rotatably supported between the peripherally extending flange 36 and the fixing element 60. When the two compressed air passages 18 are supplied with compressed air, a respective gas cushion 50 is produced between the porous spindle sleeves 24 and the roller sleeve 34. The two air cushions 50 provide for virtually friction-free support for the roller sleeve 34 at the roller spindle 14.

It will be seen from the preferred embodiments of the invention as described hereinbefore that the configuration of the guide roller 10 with a roller spindle 14 which is fixed with respect to the support structure of the stamping machine in which the roller 10 is to be used, at least one porous air-permeable spindle sleeve which is fixed on the roller spindle 14 and at least one roller sleeve which is supported by means of an air cushion at the at least one air-permeable spindle sleeve provides that the or each roller sleeve is supported in a virtually friction-free manner so that it is possible to achieve an increase in machine output, by providing for an increase in the machine speed to around the order of magnitude of 300 m/min. A further advantage of the invention is that the fact that the at least one air-permeable spindle sleeve and the at least one roller sleeve supported at the at least one spindle sleeve are permanently subjected to the action of compressed air or other suitable compressed gas during operation of the stamping machine means that, even in the start-up phase of the stamping machine equipped with the guide roller according to the invention, the initial break-away torque of the guide roller is of a minimal value so that it is possible to achieve a rapid rise in the speed of the machine during the machine start-up phase.

It will be appreciated that the above-described embodiments of the invention have been set forth solely by way of example and illustration of the principles thereof and that various other modifications and alterations may be made therein without thereby departing from the spirit and scope of the invention.

What is claimed is:

1. A guide roller for a stamping machine for guiding a web therein, comprising:

a roller spindle including at least first and second mutually axially spaced end mounting portions and between the end mounting portions a central portion of reduced diameter in relation thereto, and means for fixing the roller spindle in its operative position in the stamping machine, at least one porous air-permeable spindle sleeve having first and second axially mutually remote end portions with annular end faces and fixed by said end portions to the roller spindle, a roller sleeve mounted at the spindle sleeve, the roller sleeve comprising first and second mutually axially remote end portions, an annular gap between the roller sleeve and the spindle, a compressed gas passage in the roller spindle and opening into said central portion for supplying compressed gas to act on the spindle sleeve at the roller spindle, thereby to produce a gas cushion between the spindle sleeve and the roller sleeve, on the roller spindle in axially adjoining relationship with the first end mounting portion thereof a peripherally extending flange against which the spindle sleeve bears with one of the annular end faces thereof, and fixed at an end of the roller spindle that is axially remote from said flange a disk axially immovably fixing the spindle sleeve between said disk and said flange.

2. A guide roller as set forth in claim 1, wherein the roller sleeve projects with its first end portion beyond the flange and with its second end portion axially remote therefrom beyond the disk.

3. A guide roller as set forth in claim 1, wherein the roller sleeve at its mutually axially remote end portions is provided with a peripherally extending reel collar.

4. A guide roller as set forth in claim 1, wherein the spindle sleeve comprises an open-pore sintered metal.

* * * * *